US012304595B2

(12) United States Patent
Rogers et al.

(10) Patent No.: US 12,304,595 B2
(45) Date of Patent: May 20, 2025

(54) WATERCRAFT COVER

(71) Applicant: Polaris Industries Inc., Medina, MN (US)

(72) Inventors: Erik W. Rogers, Cadillac, MI (US); Michael T. Yobe, Knoxville, TN (US); Shawn P. Salmon, Somerset, WI (US); Ryan A. Anderson, Maple Grove, MN (US)

(73) Assignee: POLARIS INDUSTRIES INC., Medina, MN (US)

( * ) Notice: Subject to any disclaimer, the term of this patent is extended or adjusted under 35 U.S.C. 154(b) by 512 days.

(21) Appl. No.: 17/680,475

(22) Filed: Feb. 25, 2022

(65) Prior Publication Data

US 2022/0281560 A1 Sep. 8, 2022

Related U.S. Application Data

(60) Provisional application No. 63/156,745, filed on Mar. 4, 2021.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 3,354,892 | A * | 11/1967 | Frieder | B63B 17/02 114/361 |
| 3,399,687 | A * | 9/1968 | Frieder | B63B 17/02 114/361 |
| 6,035,800 | A * | 3/2000 | Clifford | B63B 25/002 114/364 |
| 6,260,505 | B1 * | 7/2001 | Polidan | B63B 17/02 114/361 |
| 7,472,666 | B1 * | 1/2009 | Richard | B63B 17/02 114/361 |
| 8,616,511 | B2 | 12/2013 | James | |
| 9,752,364 | B2 | 9/2017 | James | |
| 10,336,406 | B2 | 7/2019 | Alexander | |

* cited by examiner

*Primary Examiner* — Lars A Olson
(74) *Attorney, Agent, or Firm* — SCHWEGMAN LUNDBERG & WOESSNER, P.A.

(57) ABSTRACT

Cover designs for watercraft, such as pontoon boats, facilitate easy deployment and removal, as well as compact and convenient storage. The cover may be collapsed and deployed in a predetermined manner with a minimized chance of becoming twisted, bunched or otherwise disorganized. The cover may be reducible to sections which can be individually collapsed and deployed. The cover may include collapsible poles which can be extended and retracted as the cover is deployed and collapsed. The cover may be stored in a dedicated storage container permanently fixed to the watercraft, such that the cover can be deployed from, and collapsed into, the storage container.

13 Claims, 17 Drawing Sheets

WATERCRAFT COVER

CROSS-REFERENCE TO RELATED APPLICATION

This application claims the benefit of U.S. Provisional Application Ser. No. 63/156,745 filed Mar. 4, 2021 and entitled WATERCRAFT COVER, the entire disclosure of which is hereby expressly incorporated herein by reference.

BACKGROUND

1. Technical Field

The present disclosure relates to covers for personal watercraft and, in particular, to covers for pontoon boats.

2. Description of the Related Art

Pontoon boats have two or more longitudinally extending floatation devices, or pontoons, which provide buoyancy sufficient to float the pontoon, a deck mounted atop the pontoons, associated boat equipment including seats and controls, and passengers and cargo. Pontoon boats are favored for their large deck areas, smooth ride, and suitability for shallow-water use, beach-docking capability, and general suitability for small lakes and rivers.

When not in use, pontoon boats may be covered to protect the deck, seats, console and other items from rain, debris and weather. However, such covers can be bulky and sometimes require significant effort to install and remove.

What is needed is an improvement over the foregoing.

SUMMARY

The present disclosure provides cover designs for watercraft, such as pontoon boats, which facilitate easy deployment and removal, as well as compact and convenient storage. The cover may be collapsed and deployed in a predetermined manner with a minimized chance of becoming twisted, bunched or otherwise disorganized. The cover may be reducible to sections which can be individually collapsed and deployed. The cover may include collapsible poles which can be extended and retracted as the cover is deployed and collapsed. The cover may be stored in a dedicated storage container permanently fixed to the watercraft, such that the cover can be deployed from, and collapsed into, the storage container.

In one form thereof, the present disclosure provides a cover for a personal watercraft, the cover including a first end section sized and configured to be mounted to a bow of the watercraft, a second end section sized and configured to be mounted to a stern of the watercraft, and a middle section sized and configured to be mounted to a middle portion of the watercraft between the first end section and the second end section.

In another form thereof, the present disclosure provides a method of covering a personal watercraft. The method includes deploying a forward end section by unfolding a first plurality of poles from a folded configuration, in which the first plurality of poles are substantially parallel to one another, to a deployed configuration, in which the first plurality of poles extend radially outwardly from a first central pole retainer, placing the deployed forward end section over a bow portion of the watercraft, deploying an aft end section by unfolding a second plurality of poles from a folded configuration, in which the second plurality of poles are substantially parallel to one another, to a deployed configuration, in which the second plurality of poles extend radially outwardly from a second central pole retainer, placing the deployed aft end section over the stern portion of the watercraft, and coupling the forward end section to the aft end section.

In yet another form thereof, the present disclosure provides a cover for a personal watercraft. The cover includes a fabric sized to be received over a portion of the personal watercraft enclosed by a railing, the fabric having a pair of attachment points configured for attachment to a deck of the personal watercraft, and a plurality of collapsible poles coupled to an undersurface of the fabric and extendable from a storage configuration to an extended configuration, each of the plurality of collapsible poles having an end configured for attachment to the deck of the personal watercraft.

In still another form thereof, the present disclosure provides a cover for a personal watercraft. The cover includes a fabric sized to be received over a portion of the personal watercraft enclosed by a railing, a container sized and configured to be fixed to a bow portion of the personal watercraft, the container containing the fabric when the cover is in a collapsed configuration, and a lid receivable over the container to enclose the cover in the collapsed configuration.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention, the embodiments disclosed below are not intended to be exhaustive or to be construed as limiting the invention.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems or devices. Accordingly, embodiments may take the form of a hardware implementation, or an implementation combining software and hardware aspects. The following detailed description is therefore not to be taken in a limiting sense, and the scope of the present disclosure is defined by the appended claims and their equivalents.

Figure 1:
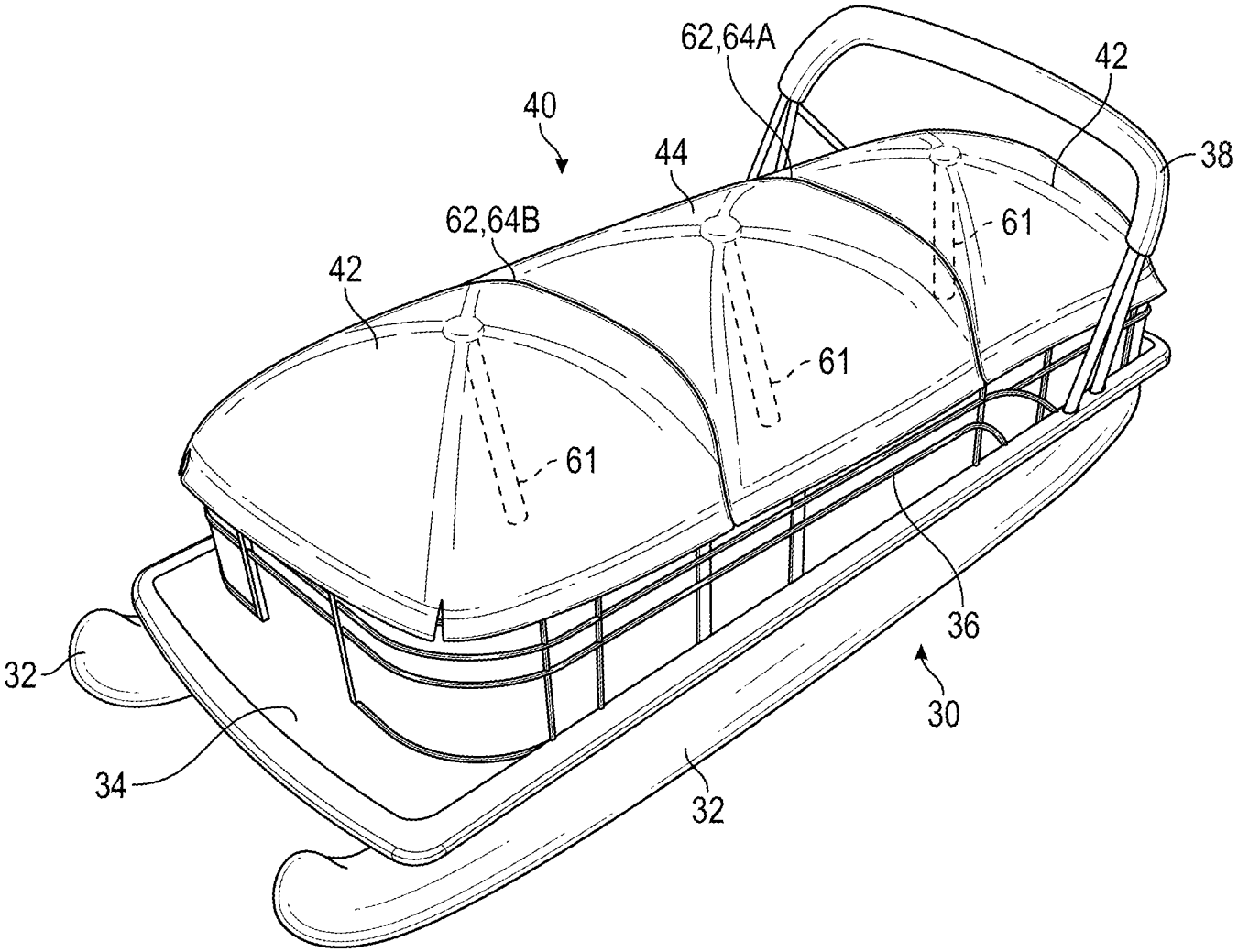
FIG. 1 is a top perspective view of a watercraft with a cover made in accordance with the present disclosure mounted thereto.

Turning now to FIG. 1, watercraft 30 is a shown as a pontoon boat having at least two pontoons 32 mounted to a lower surface of deck 34. Pontoons 32 provide buoyancy for themselves, deck 34 and all the structures and equipment supported by deck 14, which may include a motor, seats, a console, and other equipment. The motor (e.g., motor 139 shown and described with respect to watercraft 130 shown in FIG. 11 and further described below) is mounted at the stern of watercraft 30 and controlled by the console, which is also used for controlling the direction of travel for watercraft 30 (e.g., by turning the motor about a vertical axis). In the illustrated embodiment, arch 38 extends upwardly from the port and starboard sides of watercraft 30 and may support a number of additional structures, such as canopies, speakers and the like. A railing 36 surround at least a portion of the outer periphery of the deck 34 to provide a secure interior space for passengers.

Watercraft 30 includes a cover assembly 40 mounted to railing 36. In the illustrated embodiment, cover assembly 40 includes a first end section 42 at the bow of watercraft 30, a second end section 42 at the stern of watercraft 30, and a middle section 44 disposed between the end sections 42. As described in detail below, end sections 42 and middle section 44 are deployable from a compacted configuration and may be modularly connected to one another to create a complete cover extending across all of the deck 34 surrounded by railing 36.

In the illustrated embodiment, end sections 42 may be substantially identical, and installed as mirror images of one another. A single middle section 44 is shown having approximately the same dimensions as end sections 42, though alternative middle sections may be used to accommodate different lengths or designs of watercraft. In some embodiments, multiple middle sections may be used. In other embodiments, no middle section may be used, with cover 40 including only a pair of end sections 42.

Figure 2:
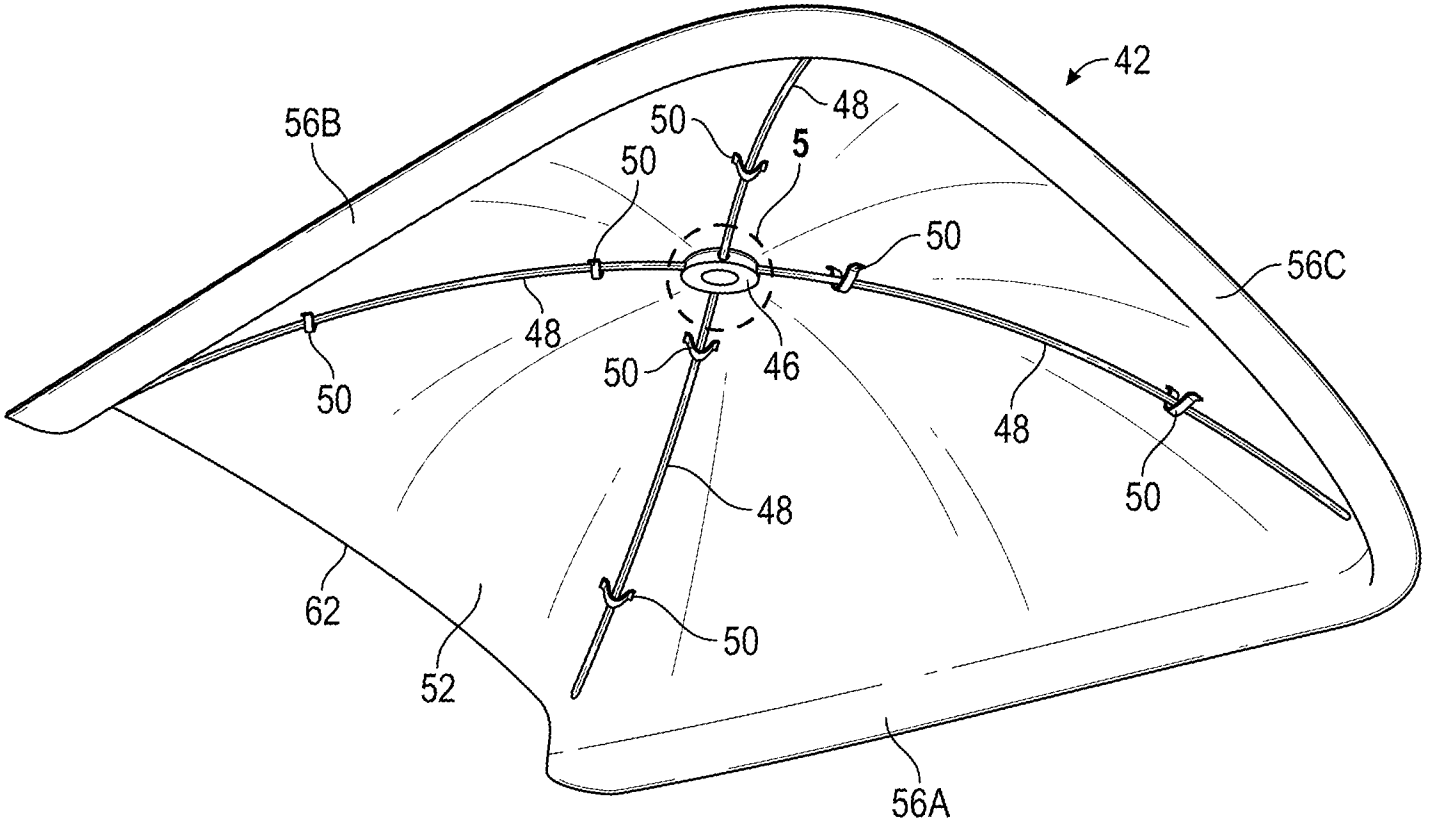
FIG. 2 is a bottom perspective view of an end section of the cover shown in FIG. 1.
Figure 4:
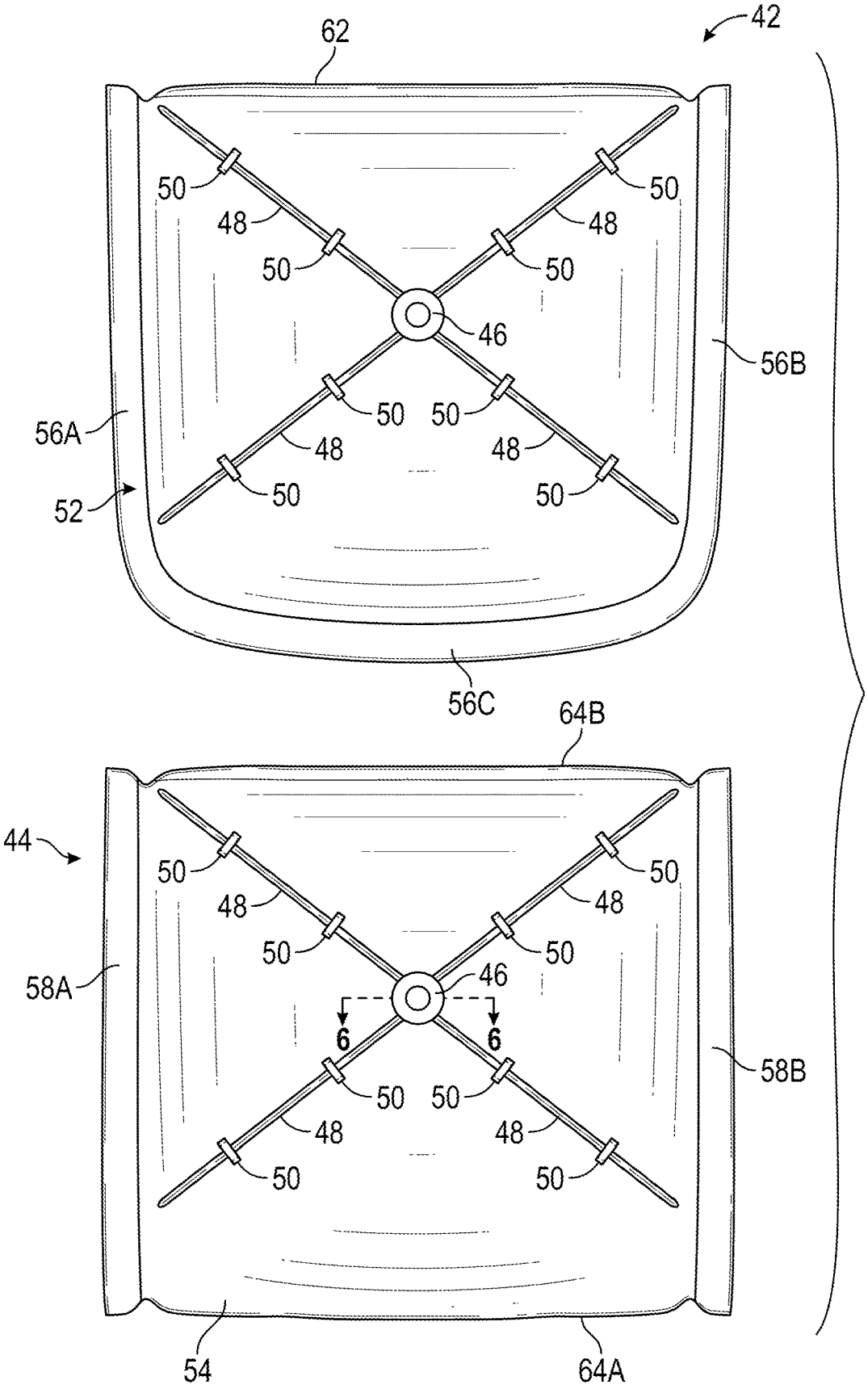
FIG. 4 is a bottom plan view of the end and middle sections of the cover shown in FIG. 1.

An undersurface of the fabric 52 of end section 42 is shown in FIG. 2. A pole retainer 46 is disposed at or near the middle of the undersurface. Pole retainer 46 has a domed top surface (FIGS. 5 and 6) which abuts, and may be fixed to, fabric 52. As best seen in FIG. 4, a plurality of poles 48, such as four poles 48 as shown, are coupled to pole retainer 46 and extend outwardly therefrom at generally right angles from one another to create an X-shape. Poles 48 are made from resiliently deformable material, such as plastic or fiberglass, and/or have a pre-defined curved shape to impart a convex, generally dome-shaped profile to the upper surface of fabric 52. Poles 48 are retained in position against the undersurface of fabric 52 by loops 50 sewn, welded or otherwise fixed to fabric 52, as shown. In one embodiment, poles 48 may also be fitted into pockets, grommets or other features of fabric 52 to fix the outer end of each pole 48 in place.

Fabric 52 of end section 42 also includes three flaps 56A, 56B, 56C which extend downwardly and are joined to one another at two corners of end section 42, as shown in FIG. 2. A pair of side flaps 56A and 56B are sized and configured to extend over starboard and port edges of railing 36, as shown in FIG. 1. Where end section 42 covers the forward portion of deck 34, flap 56C is a bow flap covering and extending over the forward edge of railing 36. Where end section 42 covers the aft portion of deck 34, flap 56C is a stern flap covering and extending over the aft edge of railing 36.

Fabric 52 of end section 42 includes a fourth edge extending between side flaps 56A and 56B and opposite flap 56C. As best seen in FIG. 2, this fourth edge does not include a flap, but does include an attachment feature 62. Attachment feature 62 may be a zipper, a set of ties and grommets, a strip or set of hook-and-loop fasteners, or any other attachment feature suitable to join the fourth edge of end section 42 to an adjacent or abutting attachment feature, such as one of attachments features 64A or 64B formed at the forward and aft edges of middle section 44, as illustrated in FIG. 1 and described further below. Where end section 42 covers the forward portion of deck 34, attachment feature 62 is positioned at an aft edge of fabric 52 such that it can couple with the forward edge of an abutting section, such as middle section 44. Where end section 42 covers the aft portion of deck 34, attachment feature 62 is positioned at a forward edge of fabric 52 such that it can couple with the aft edge of an abutting section.

Figure 3:
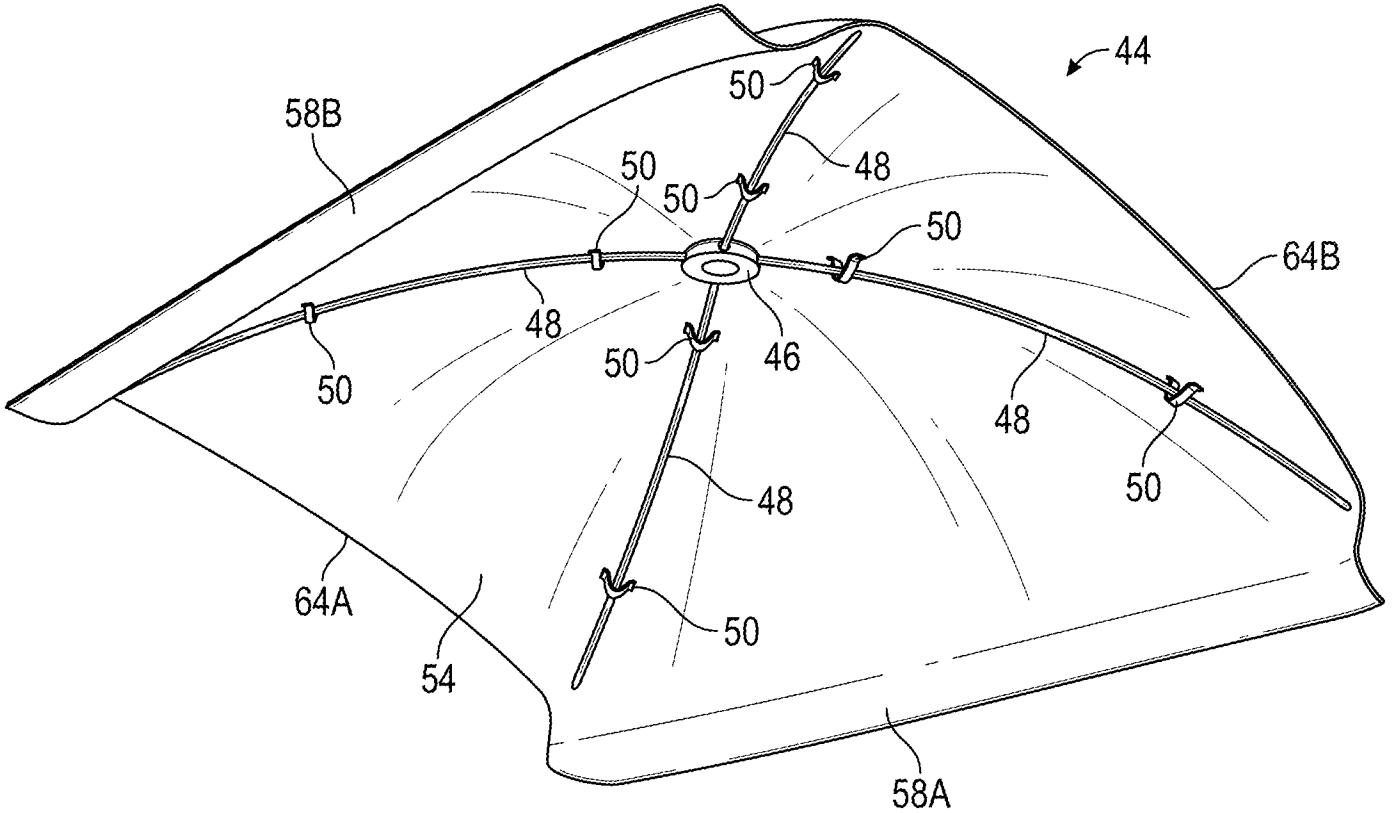
FIG. 3 is a bottom perspective view of a middle section of the cover shown in FIG. 1.

Turning now to FIG. 3, an undersurface of the fabric 54 of middle section 44 is shown. Middle section 44 is constructed similarly to end section 42, with a generally central pole retainer 46 having a plurality (e.g., four) poles 48 extending radially outwardly therefrom. The construction of middle section 44 may be considered to be the same as the construction of end section 42, except as otherwise noted herein.

The primary difference of middle section 44 is that it includes only two flaps 58A, 58B which are mutually opposite one another, and are sized and configured to extend over starboard and port edges of a center portion of railing 36 (FIG. 1). The other two edges of the fabric 54, which are the aft and forward edges, have attachment features 64A, 64B respectively. Upon installation in the illustrated configuration of FIG. 1, the forward attachment feature 64A fixes to the adjacent attachment feature 62 of the forward end section 42, while the rear attachment feature 64B couples to the adjacent attachment feature 62 of the aft end section 42.

When so coupled, the first end section 42, the second end section 42 and the middle section 44 are fixed to one another to create cover 40, which functions as a single unitary cover. Cover 40 provides complete coverage over the portion of deck 34 within railing 36, which includes all the seats, the console and controls, and other structures.

Figure 5:
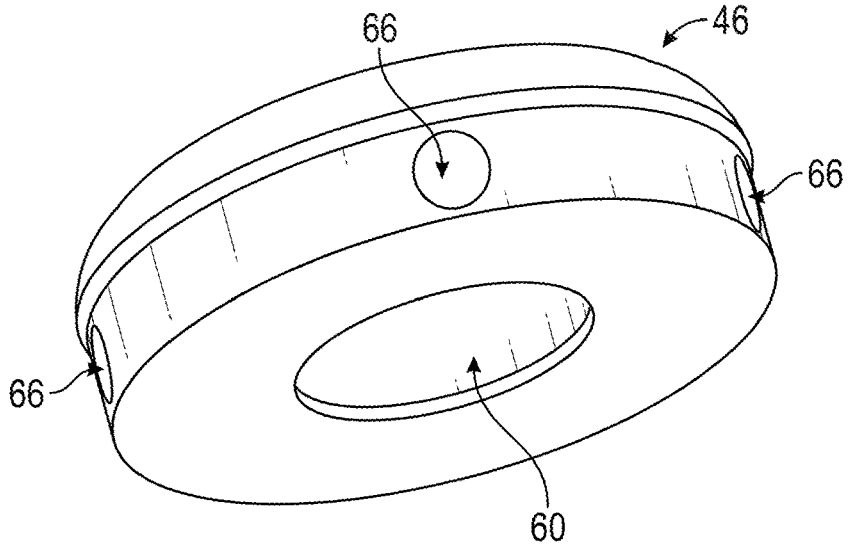
FIG. 5 is a bottom perspective view of a pole retainer used with the cover of FIG. 1.
Figure 6:
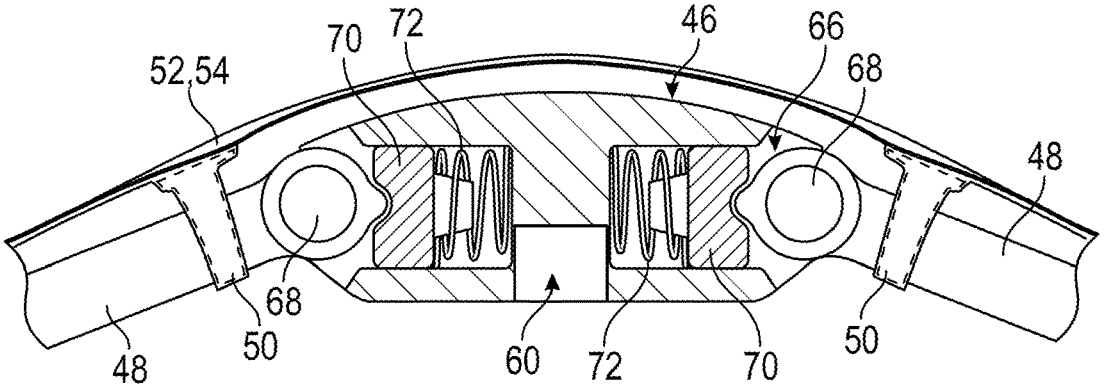
FIG. 6 is a side elevation, cross-section view of the pole retainer shown in FIG. 1, as integrated into the cover of claim 1.

In an exemplary embodiment, a set of posts 61 (FIG. 1) have lower ends supported upon deck 34 and upper ends received within post aperture 60 of pole retainer 46, which extends upwardly into the body of pole retainer 46 as shown in FIGS. 5 and 6. Each post 61 supports one of the sections 42, 44 and ensures that the upper surface thereof retains is convex, generally dome-shaped profile even in adverse conditions, such as in high winds, in heavy rain, or under snow loads.

Figure 8:
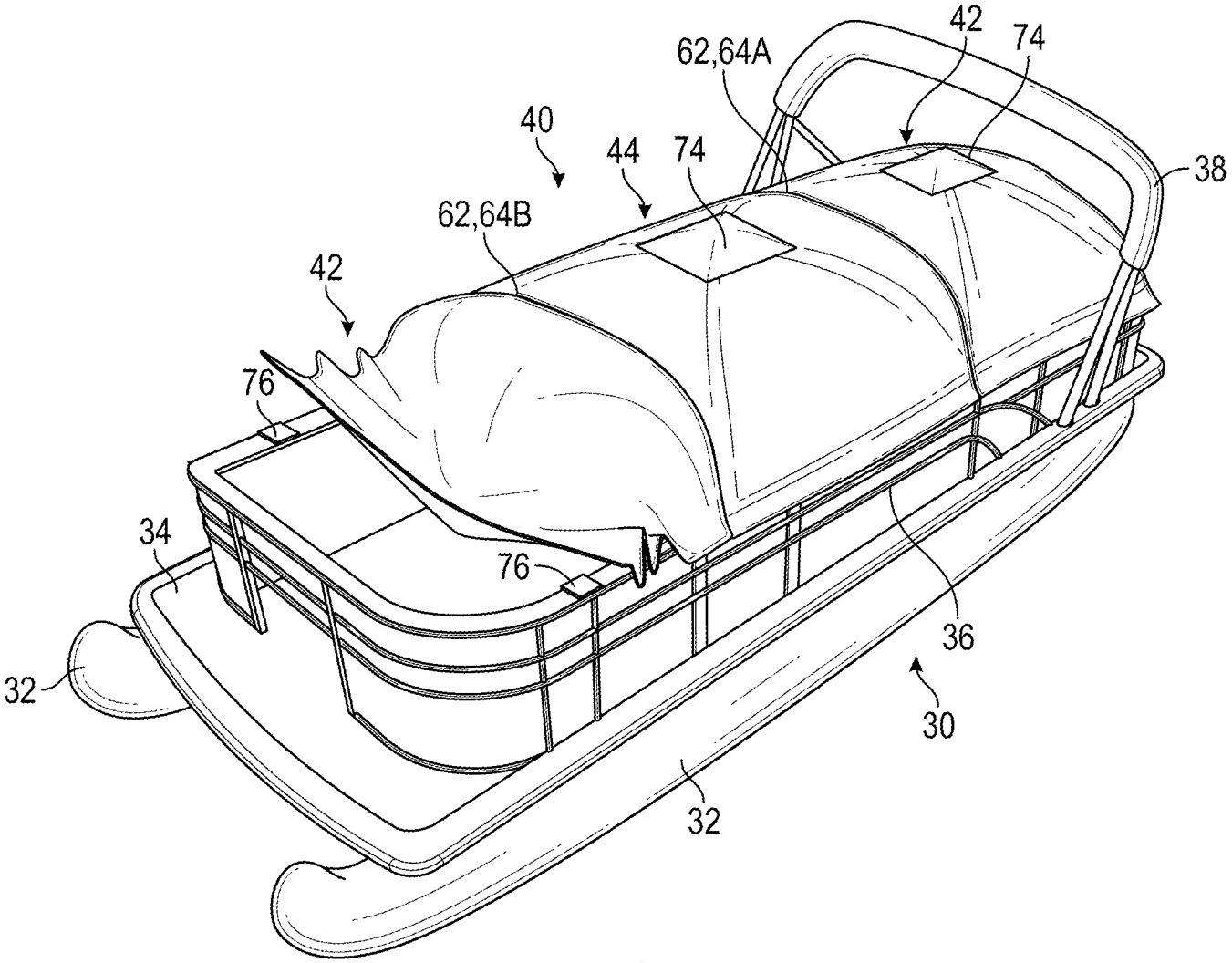
FIG. 8 is another top perspective view of the cover shown in FIG. 1, showing an installation procedure and including optional cover vent panels.

Turning to FIG. 8, cover 40 may optionally include vent panels 74 disposed on each of end sections 42 and middle section 44. Vent panel 74 covers an opening at the center of fabric 52, 54 at and around pole retainer 46, and extends radially beyond the opening to provide an overlapping peripheral margin. This overlap prevents rain or detritus from entering, but allows moisture trapped under cover 40 to escape through the open slits between fabric 52, 54 and a respective vent panel 74. In some embodiments, vent panel 74 may be installed on less than all of the section 42, 44, such as one or two sections.

Turning now to FIGS. 5 and 6, pole retainer 46 is shown in additional detail. Pole retainer 46 includes a post aperture 60 formed in its undersurface, which extends upwardly from the undersurface to a terminal end within the body of retainer 46 (FIG. 6). Post aperture 60 is sized to receive an upper end of a post 61, as shown in FIG. 1 and described above. Pole retainer 46 further includes a plurality of pole apertures 66 arranged around its periphery and extending radially inwardly from the periphery, such as four apertures 66 as shown. Each aperture 66 is sized to receive and couple with an upper/inner end of a respective pole 48 as best seen in FIG. 6.

Figure 7:
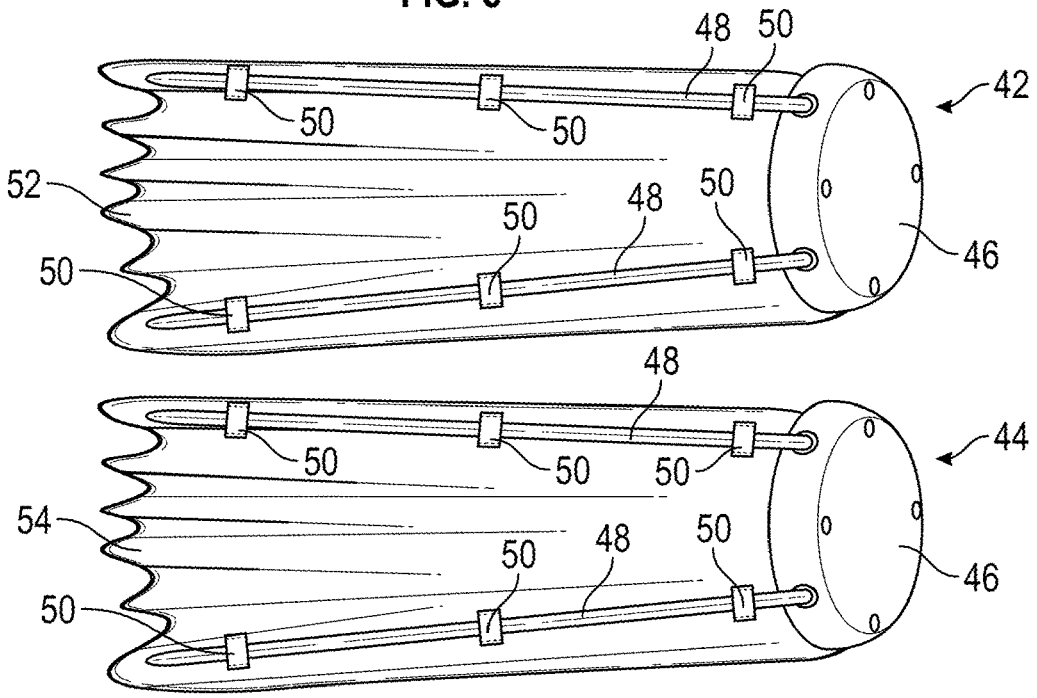
FIG. 7 is a side perspective view of the cover sections shown in FIG. 4, shown in a collapsed configuration.

Referring to FIG. 6, an exemplary embodiment of pole retainer 46 includes a detent mechanism which facilitates proper orientation of poles 48 in the deployed configuration of sections 44, 44, but also allows poles 48 to be folded down into a collapsed, storage configuration as shown in FIG. 7 and further described below. In the illustrative embodiment of FIG. 6, each aperture 66 has a detent slider 70 slidably received therein and biased outwardly by a biasing element 72. Detent slider 70 includes a dimple, as shown, while the adjacent pole 48 includes a cam end 68 with a protrusion sized to be selectively received within the dimple. When so received, cam end 68 and detent slider 70 cooperate to releasably retain pole 48 in its position by the biasing force of biasing element 72. When sufficient folding force is applied to pole 48, the dimple and protrusion may move out of registration as biasing element 72 is compressed, allowing poles 48 to be rotated into a folded configuration in which poles 48 are substantially parallel to one another (FIG. 7).

In use, each cover end section 42 and the required number of middle sections 44 may be retrieved from a storage container in a collapsed configuration, as shown in FIG. 7. End section 42 may be deployed into the expanded configuration by rotating poles 48 into their deployed positions. A post 61 may be placed upon deck 34, as shown in FIG. 1, and inserted into post hole 60 of pole retainer 46. The deployed end section 42 may be placed over the stern or bow edges of railing 36, as desired, and over the adjacent starboard and port edges of railing 36 as shown in FIGS. 1 and 8.

The middle section 44 may then be similarly deployed from the collapsed configuration of FIG. 7 into the deployed configuration of FIGS. 1 and 8. Post 61 may be rested on deck 34 and inserted into post hole 60 in the same manner. Either before or after fully deploying middle section 44, attachment edge 62 is coupled to the adjacent edge 64A, 64B, such as by zippering or otherwise attaching the edges as noted above.

The second end section 42 can then be deployed and attached in a similar fashion. In the illustrated embodiment of FIG. 8, the forward end section 42 is attached at edges 62, 64B and then dragged or pulled forwardly to pull fabric 52 taut over railing 36. As the fabric is pulled taut, poles 48 (FIG. 2) may be automatically rotated to their deployed positions. In this way, each cover section 42, 44 may be attached and pulled forward or aft to complete installation by a single person.

In one embodiment, railing 36 may include a series of magnets 76 attached thereto, and sections 42, 44 may have additional magnets 76 of opposite polarity fixed thereto and positioned to meet magnets 76. As each section 42, 44 is pulled taut over railing 36, magnets 76 meet and magnetically couple to one another to retain cover 40 upon railing 36.

Advantageously, cover 40 provides the weather protection of a traditional, one-piece cover, but is much easier to deploy, remove, store and manage because it can be broken down into sections.

Turning now to FIGS. 9-15, covers 140A and 140B in accordance with the present disclosure are shown. Covers 140A, 140B are similar in structure and function to cover 40 described above, and reference numbers used to describe cover 140A, 140B are analogous to the reference numerals used in cover 40, except with 100 added thereto.

However, covers 140A, 140B have a single piece of fabric 152 extending over the length of railing 136, which is supported by a pair of longitudinally-extending pole assemblies 148 that substantially span a length of watercraft 130 from a bow portion to a stern portion thereof.

Figure 9:
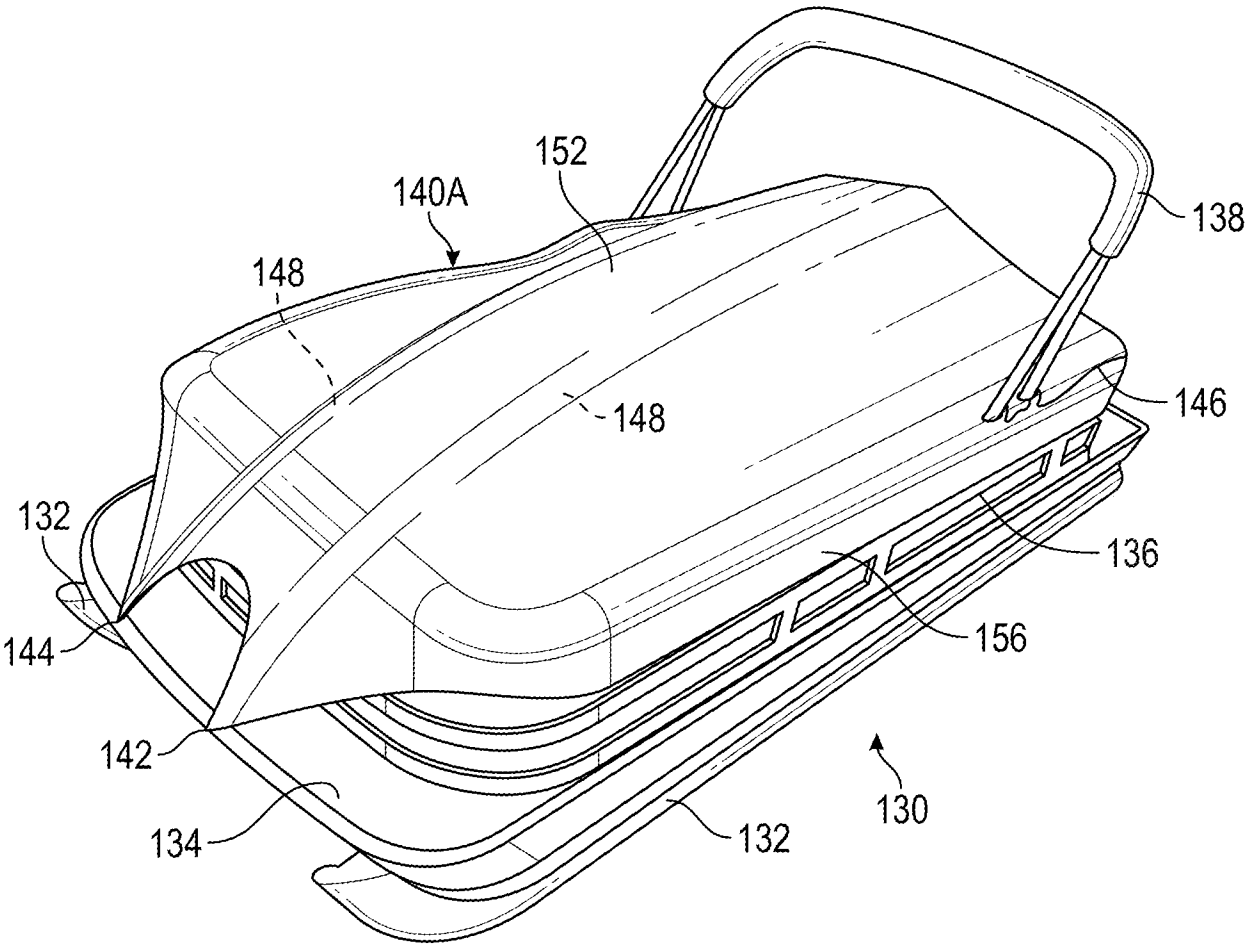
FIG. 9 is top perspective view of another watercraft with a cover made in accordance with the present disclosure mounted thereto.
Figure 10:
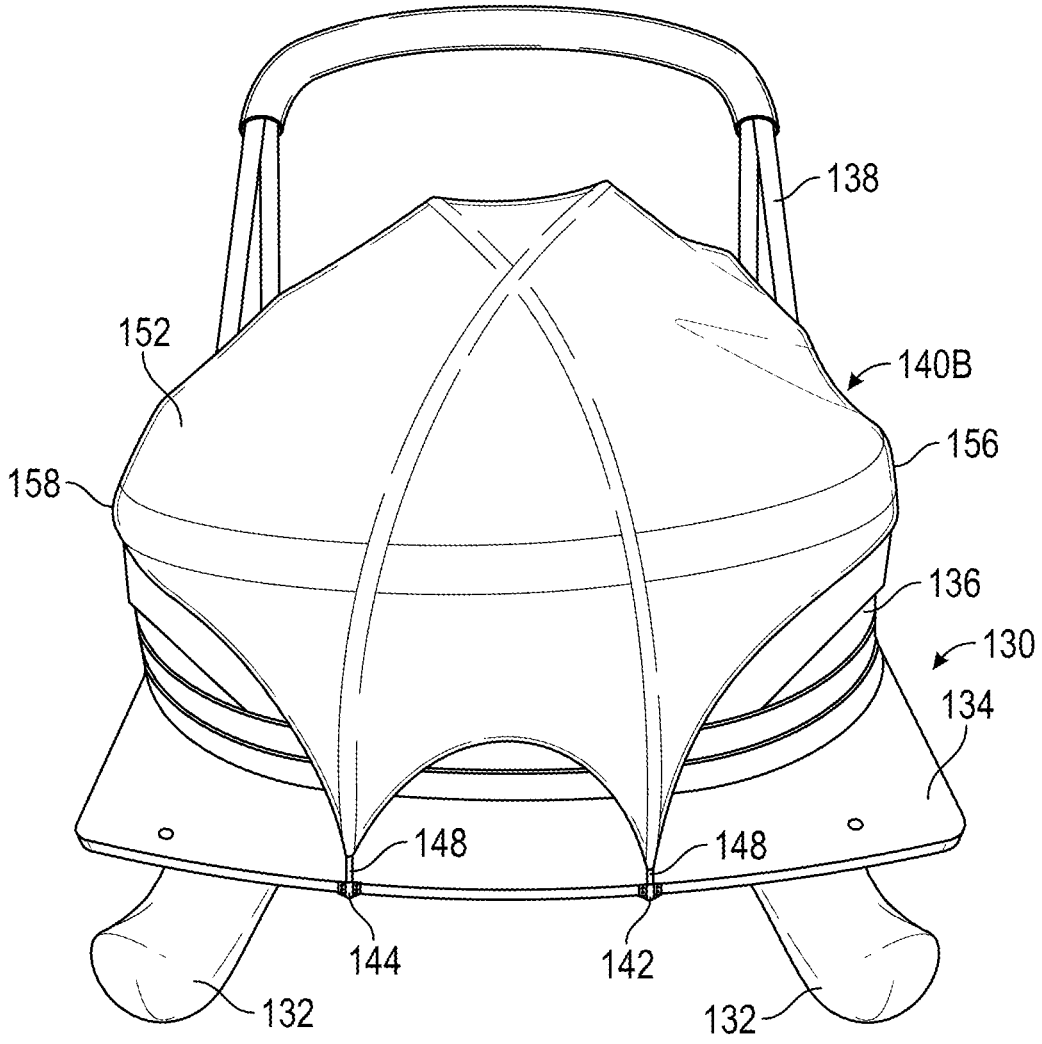
FIG. 10 is front perspective view of the watercraft shown in FIG. 9, with an alternative cover arrangement in accordance with the present disclosure.

Pole assemblies 148 may run along a substantially parallel path, as shown in FIG. 9 with respect to cover 140A, or may cross one another to form an X-shape as shown in FIG. 10 with respect to cover 140B. For purposes of the following discussion, the construction and use of covers 140A, 140B will be described together, it being understood that poles 148 may be configured in either orientation as desired or required for a particular application, and that all structures and uses of cover 140A may be applied to cover 140B and vice-versa.

Turning now to FIG. 10, covers 140A, 140B are connected to the bow of watercraft 130 via port attachment point 142 and starboard attachment point 144. In the illustrative embodiment of FIG. 10, attachment points 142, 144 are brackets connected to a forward edge of deck 134 which have an open top sized to receive ends of poles 148, and a closed bottom against which allow the ends of poles 148 to bottom out and abut brackets 142, 144.

Covers 140A, 140B extend backwardly across railing 136 when fully deployed, as shown in FIGS. 9 and 10 respectively. A forward portion of covers 140A, 140B extends to a pair of forward points which are fixed to poles 148 at or near their junctions with brackets 142, 144. The forward portion extends back to completely cover the forward rail of railing 136. A port flap 156 extends over the port-side rail of railing 136, and a starboard flap 158 extends over the starboard-side rail of railing 136.

Figure 11:
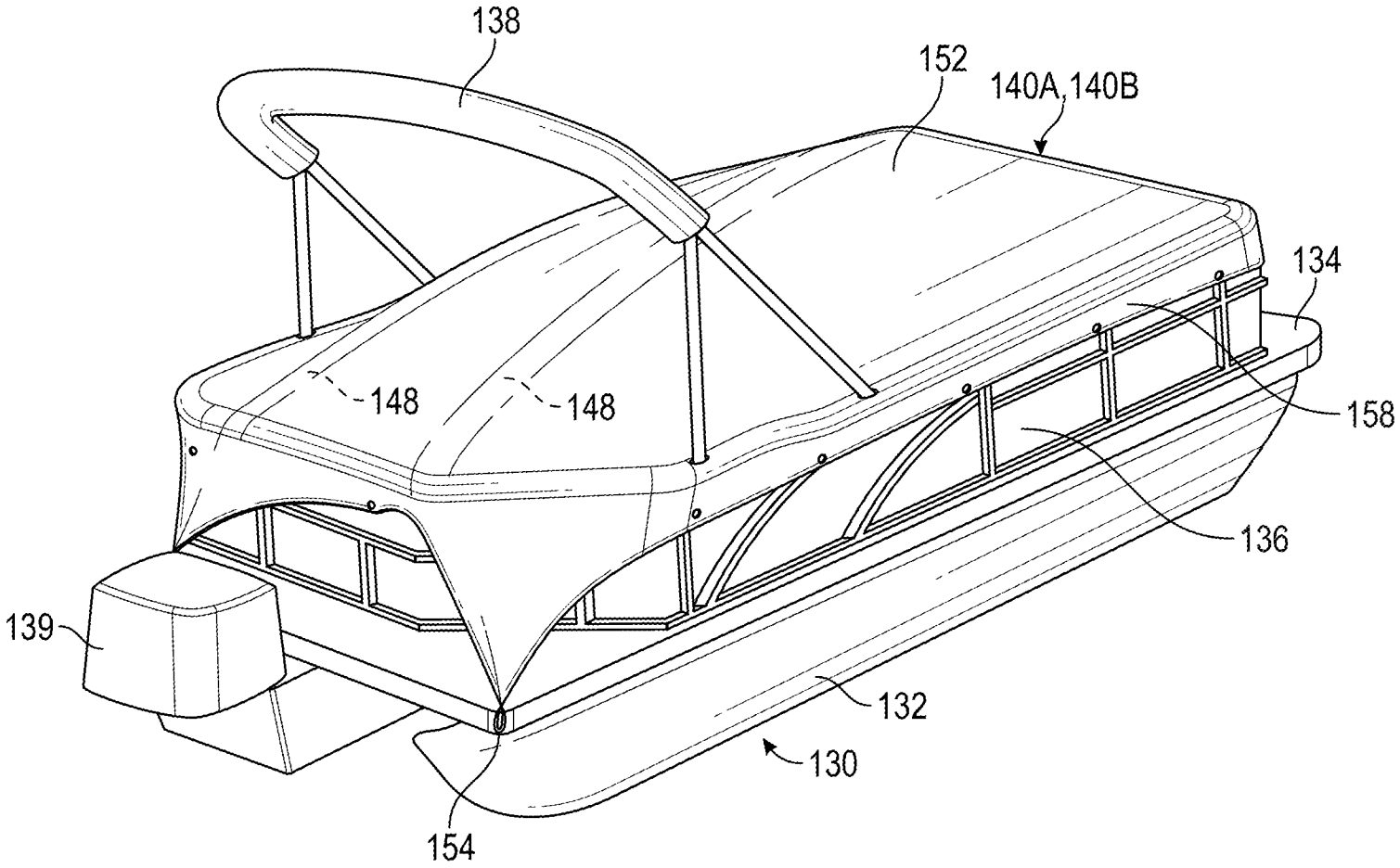
FIG. 11 is a rear perspective view of the watercraft and cover of FIG. 9 or 10.

At the stern of watercraft 130, as shown in FIG. 11, an aft portion of cover 140A, 140B extends to a second attachment point to deck 134 via port and starboard loops 153, 154. Loops 153, 154 may each be positioned to attach to a cleat or hook fixed to deck 136, and are arranged to couple with the hooks when fabric 152 of cover 140A, 140B is taut. In the illustrative embodiment of FIG. 9. Cover 140A includes slits 146 on each side at its aft portion to allow cover 140A to pass around the stanchions of arch 138. Cover 140B may also includes slits 146.

Figure 12:
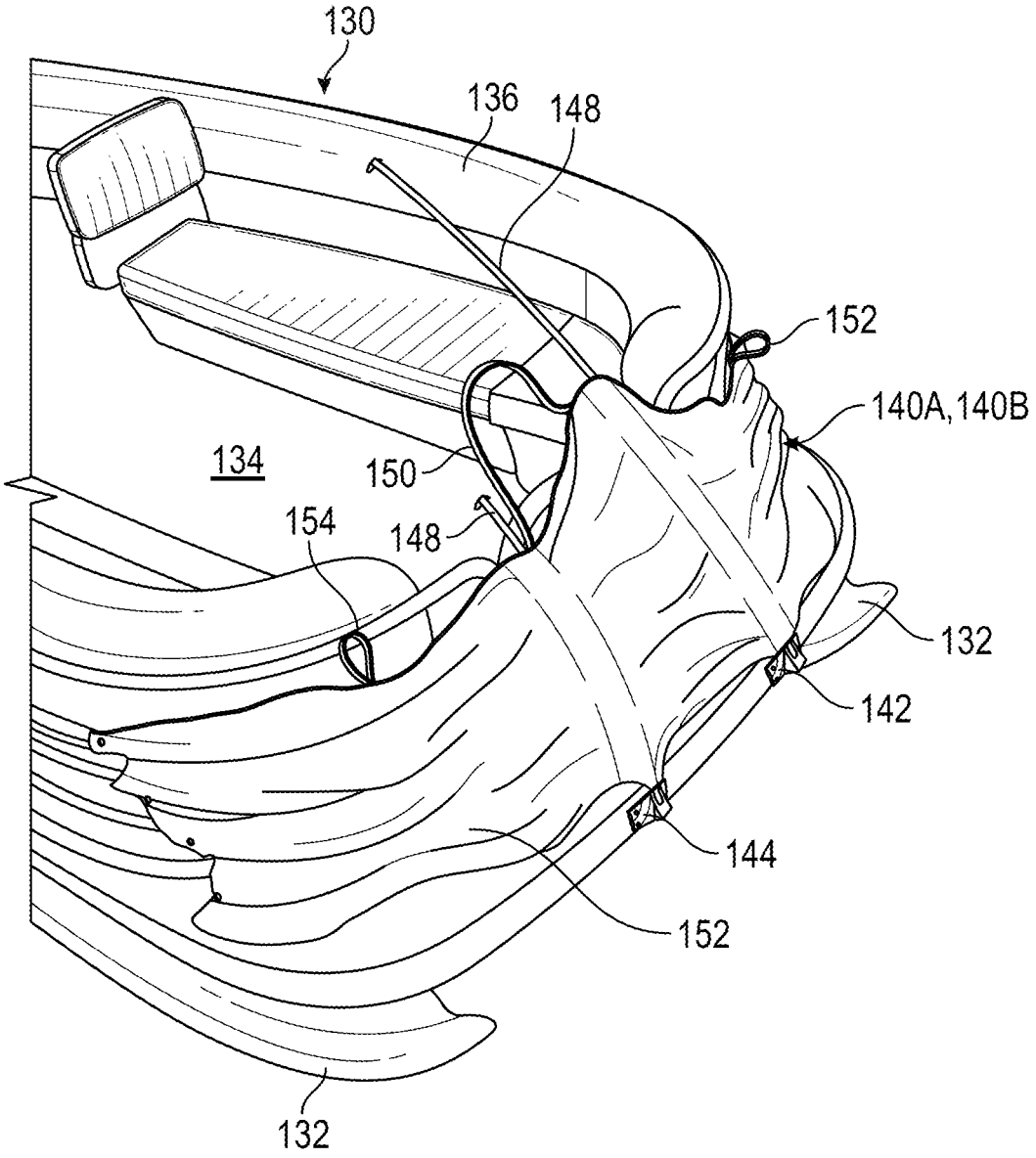
FIG. 12 is a front perspective view of the watercraft and cover of FIG. 9 or 10, shown with the cover partially deployed.

Poles 148 include multiple telescoping sections, thereby allowing each pole 148 to extend from a collapsed configuration (FIG. 12) to an extended configuration (FIGS. 9-11). To install cover 140A, 140B over watercraft 130, cover 140A, 140B may first be retrieved from a storage container, such as container 160 shown in FIG. 15. Poles 148 are fixed within brackets 142 and 144, and fabric 152 is fanned out to extend to the starboard and port sides of watercraft 130 as shown in FIG. 12. Poles 148 may then be extended as fabric 152 is drawn back over poles 148, such as by grasping and pulling handle 150 and/or attachment loops 153, 154.

Figure 13:
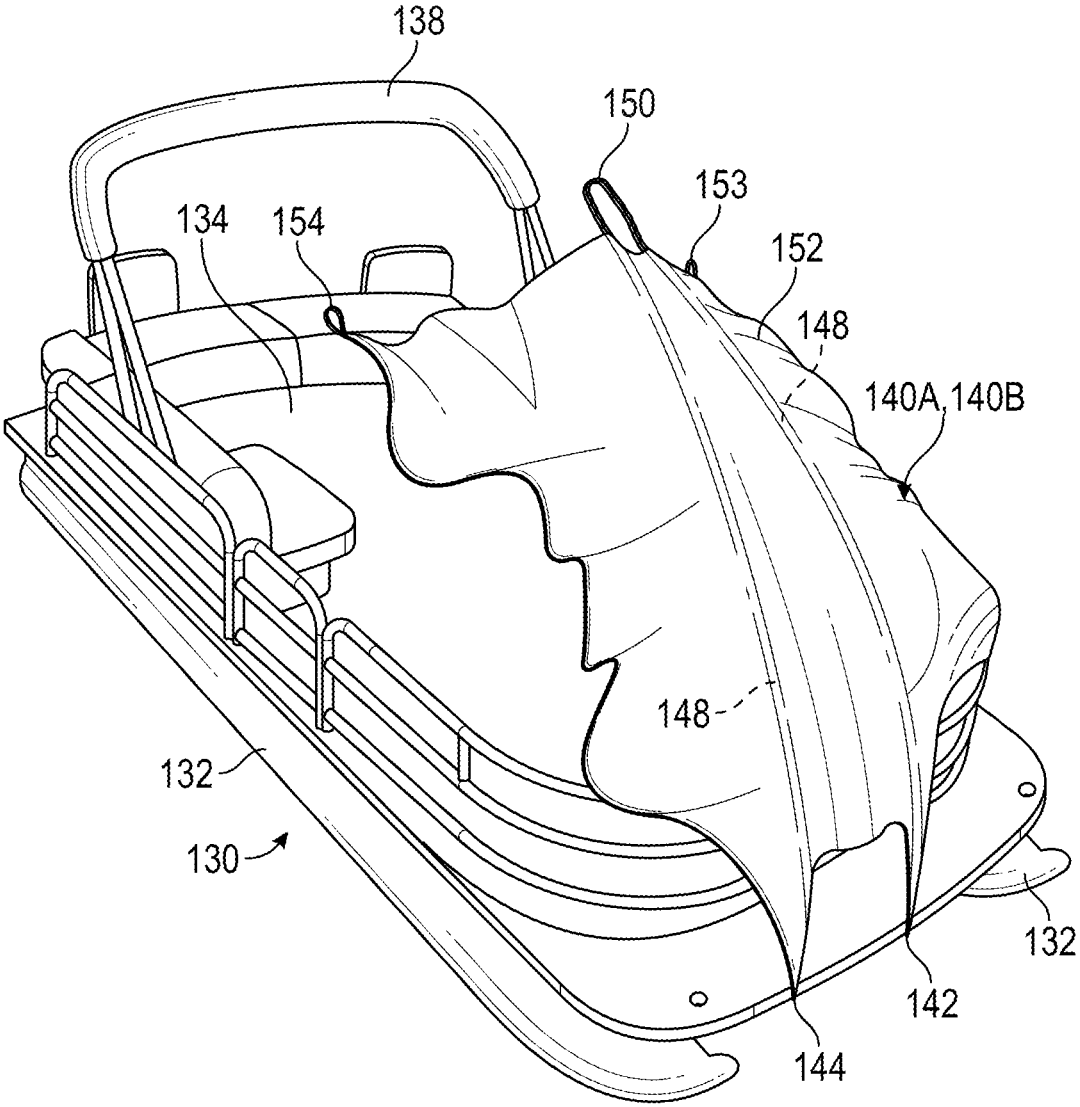
FIG. 13 is a front perspective view of the watercraft and cover of FIG. 13, shown with the cover further deployed.

As shown in FIG. 13, fabric 152 may be drawn further back with poles 148 extending simultaneously. Poles 148 may be connected to the undersurface of fabric 152 by loops, such as loops 50 shown in FIGS. 2-4 and described above with respect to cover 40. Thus, poles 148 may be automatically extended by the action of pulling fabric 152 back, or may be extended manually. When cover 140A, 140B is fully deployed and taut, loops 153, 154 may be fixed to the stern of watercraft 130 as described above. At this point, cover 140A, 140B is fully deployed.

Figure 14A:
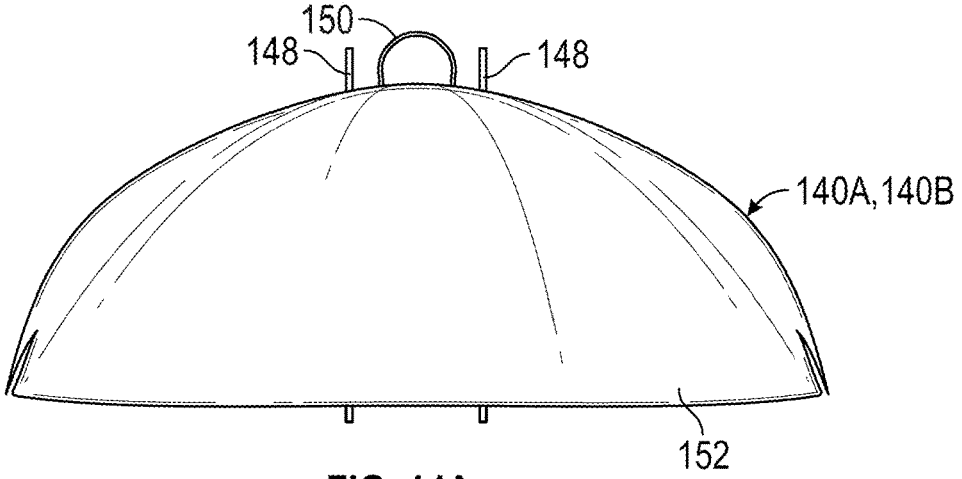
FIG. 14A is a front elevation view of the partially deployed cover shown in FIG. 12.
Figure 14B:
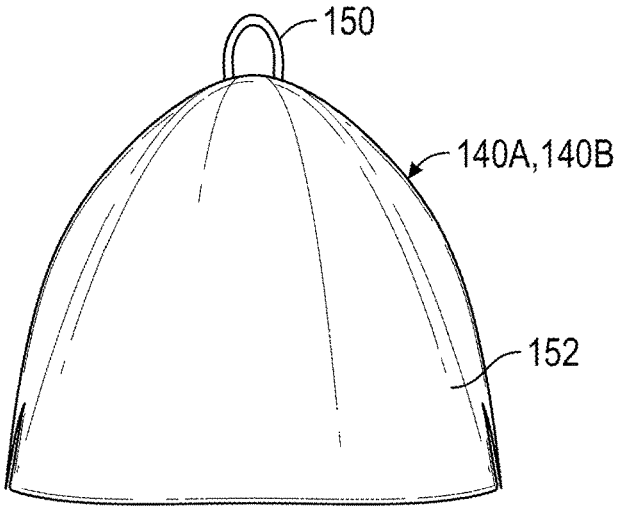
FIG. 14B is a front elevation view of the cover shown in FIG. 14A, with the cover partially collapsed.
Figure 14C:
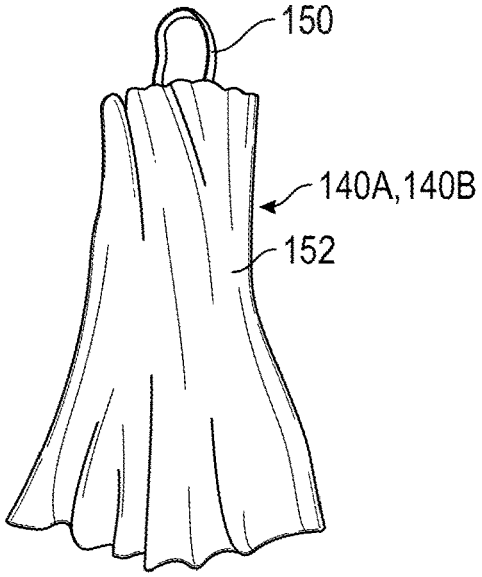
FIG. 14C is a front elevation view of the cover shown in FIG. 14B, with the cover further collapsed.
Figure 15:
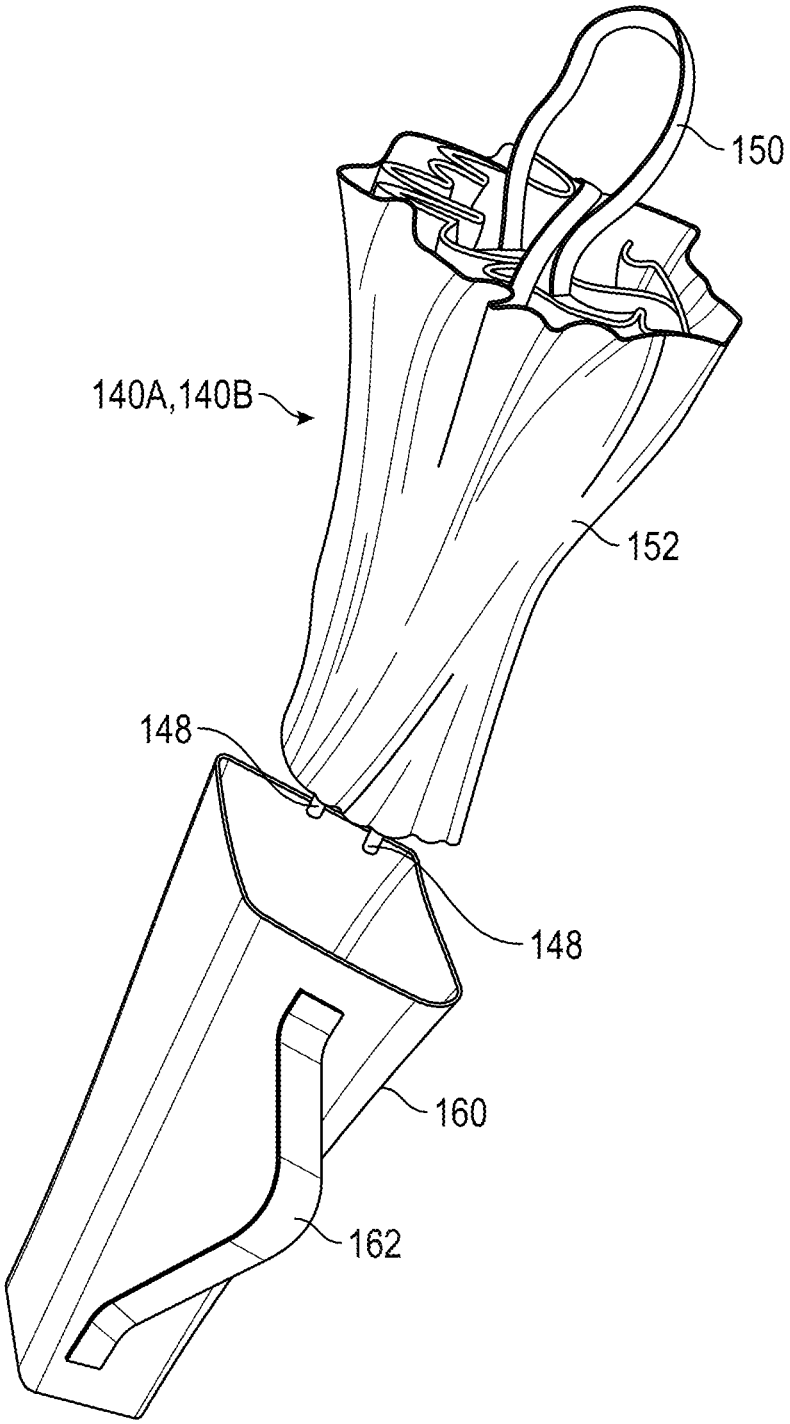
FIG. 15 is a perspective view of the collapsed cover shown in FIG. 14C, and a storage container sized to receive the collapsed cover.

When it is desired to remove cover 140A, 140B from watercraft 130, loops 153, 154 are disconnected and fabric 152 is walked back to the bow of watercraft 130, as poles 148 are reconfigured back to their compressed configurations. This intermediate configuration of cover 140A, 140B is shown in FIG. 14A, wherein fabric 152 is gathered at the bow of watercraft 130 (as also shown in FIG. 12) and poles 148 are fully compressed. The excess fabric 152 at the starboard and port sides of watercraft 130 can then be gathered up around the poles 148, as shown in FIG. 14B. When fully gathered, cover 140A, 140B assumes the configuration of FIG. 14C. At this point handle 150 remains accessible, but cover 140A, 140B has been reduced to a compact package suitable for stowage, e.g., in container 160 shown in FIG. 15. Container 160 may include handle 162 for easy transport and handling.

Turning now to FIGS. 16A-19, a further cover 240 in accordance with the present disclosure is shown. Covers 240 is similar in structure and function to covers 40 and 140A, 140B described above, and reference numerals of cover 240 are analogous to the reference numerals used in covers 40 and 140A, 140B, except with 200 or 100 added thereto, respectively.

Like cover 140A, 140B, cover 240 can be deployed by walking the cover from the bow of watercraft 230, where it is fixed, to the stern. However, while cover 140A, 140B is stored in a freestanding container 160 which may be transported and stowed in any location, cover 240 is permanently mounted in storage container 260 mounted to the bow of watercraft 230. Container 260 includes a housing 266 fixed to the forward portion of deck 234, with a lid 264 pivotably or removably attached to the housing 266.

Figure 16A:
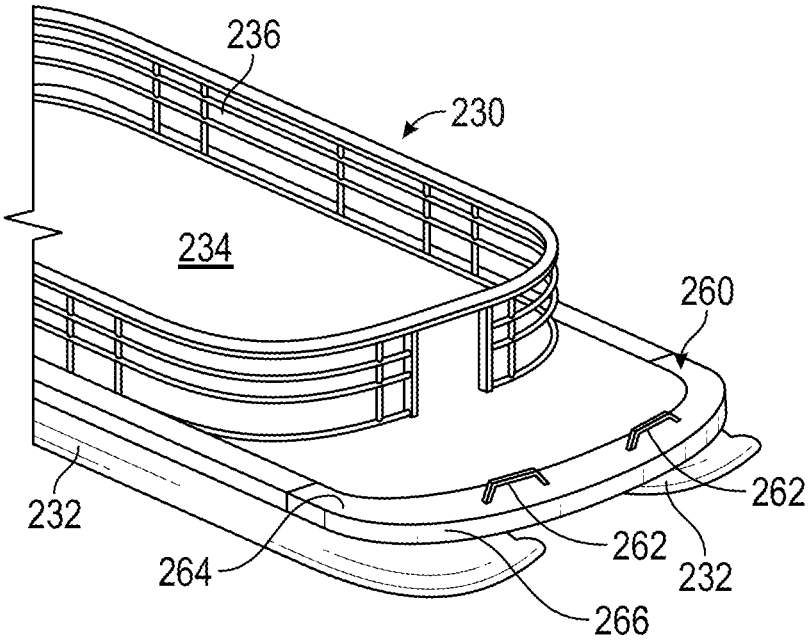
FIG. 16A is a top perspective view of another watercraft with a cover made in accordance with the present disclosure mounted thereto, shown in a stowed configuration at the bow of the watercraft.
Figure 16B:
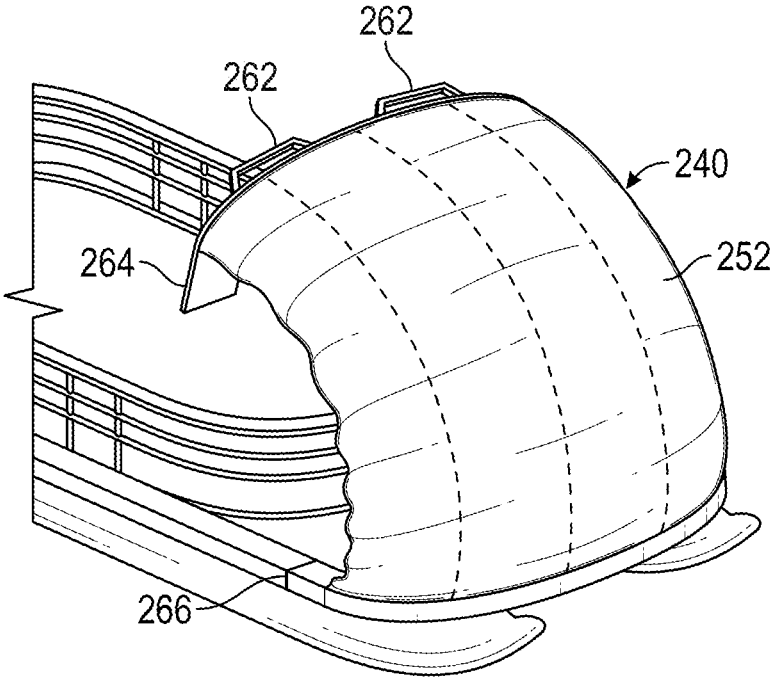
FIG. 16B is a top perspective view of the cover shown in FIG. 16B, shown in a partially deployed configuration.

In the illustrative embodiment of FIG. 16B, lid 264 is removable by pulling on handles 262, which unseats lid 264 and begins to draw fabric 252 out from housing 266. In particular, fabric 252 is fixed to the undersurface of lid 264, such that cover 240 can be deployed by simply removing lid 264 and walking it to the stern of watercraft 230.

Figure 17:
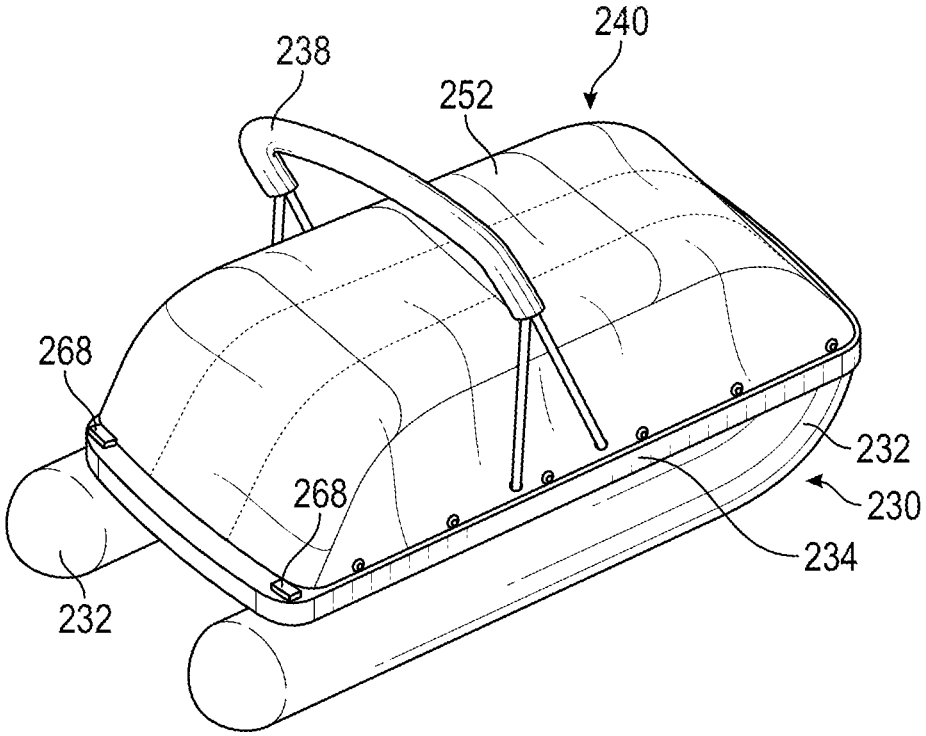
FIG. 17 is a rear perspective view of the watercraft and fully deployed cover shown in FIG. 16C.

Referring to FIG. 17, fabric 252 of cover 240 may be secured to the stern of watercraft 130 by affixing handles 262 to a complementary receiver 268 fixed to the aft portion of deck 234. Such receivers may be clamps, magnets, hook-and-loop fasteners or any other suitable attachment structure. At this point, cover 240 is fully deployed.

Figure 16C:
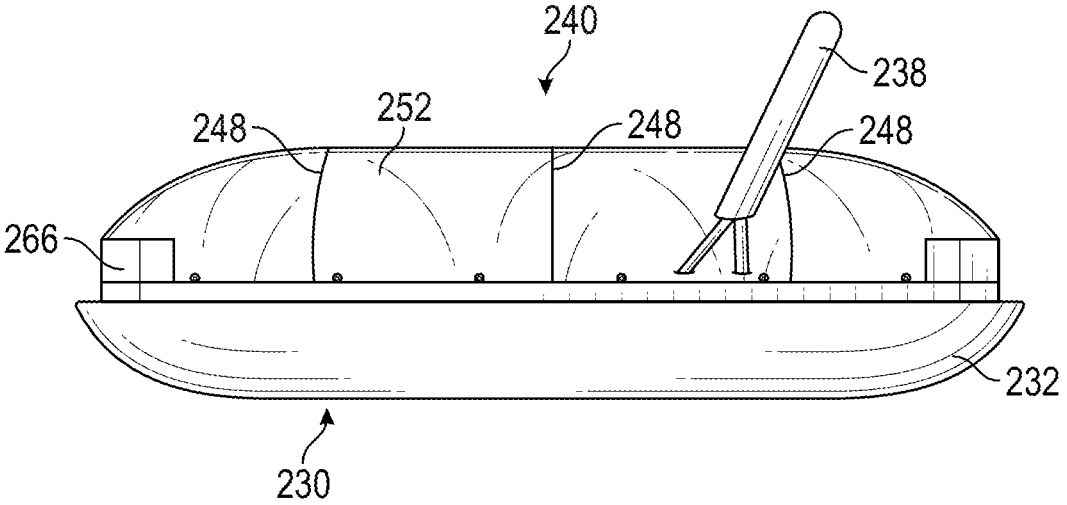
FIG. 16C is a port side, elevation view of the watercraft and cover shown in FIG. 16A, shown in a fully deployed configuration.
Figure 16D:
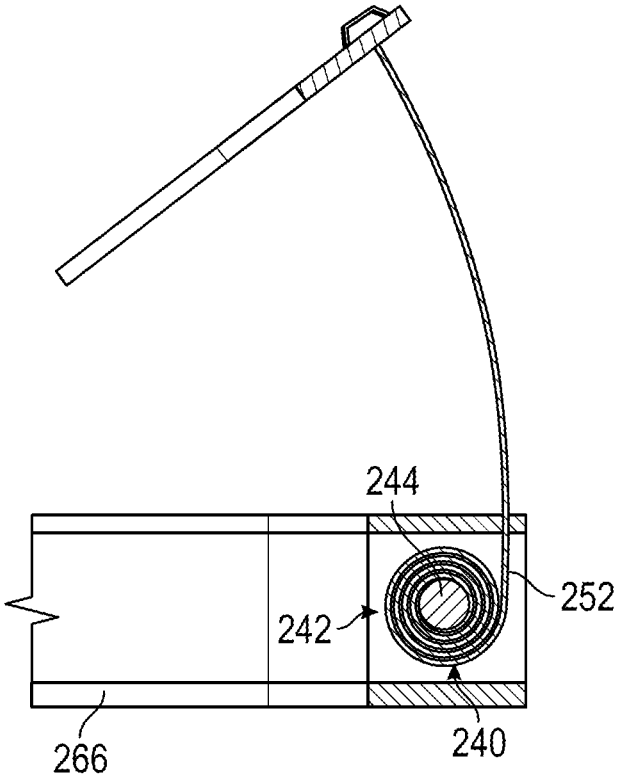
FIG. 16D is a side elevation, cross-section view of the cover shown in FIG. 16A, illustrating a winding assembly thereof.
Figure 18:
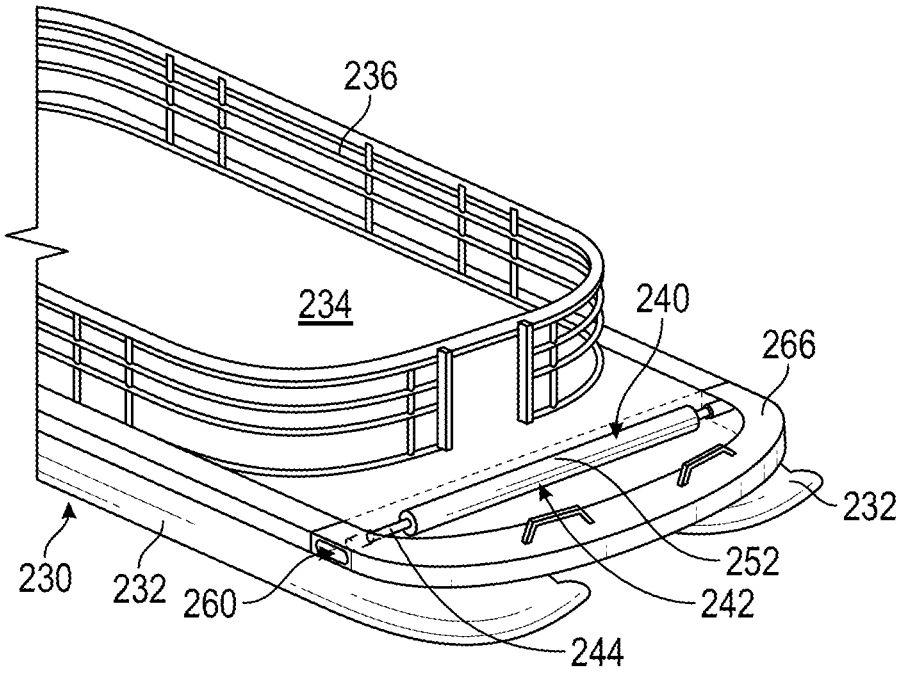
FIG. 18 is a front perspective view of the cover and winding assembly shown in FIG. 16D.

Turning to FIGS. 16D and 18, cover 240 may include a winding assembly 242 to facilitate deployment and, especially, retraction of fabric 252. Winding assembly 242 includes a shaft 244 around which fabric 252 is wound when cover 240 is fully or partially retracted. In the illustrated embodiment of FIG. 16D, the aft end of fabric 252 is fixed (e.g., welded, mechanically coupled, sewn, etc.) to the undersurface of lid 264. Shaft 244 is spring-loaded, e.g., with a torsion spring operably coupled to shaft 244, such that shaft 244 is biased toward the collapsed configuration shown in FIGS. 16D and 18.

Figure 19:
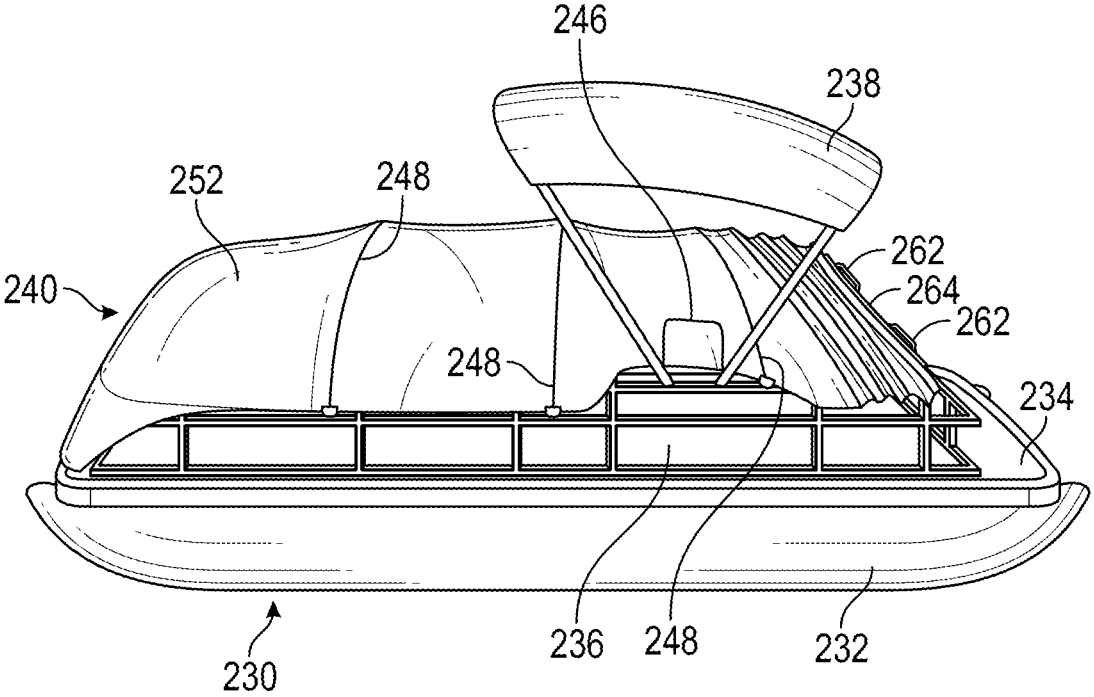
FIG. 19 is a port side, perspective view of the watercraft and cover shown in FIG. 16A, shown in the cover partially deployed.

In use, lid 264 is removed and drawn toward the stern of watercraft 230 as noted above. As the user pulls lid 264 and fabric 252 rearwardly against the biasing force of the torsion spring, fabric 252 is progressively unwound from shaft 244. As cover 240 approaches the stern of watercraft 230 as shown in FIG. 19, fabric 252 may be tucked around the stanchions of arch 238 as shown. Where the stanchions are connected to the upper or inner surface of railing 236, cover 240 may include slits 246 of an appropriate size and configuration to allow fabric 252 to pass over arch 238, as also described above with respect to covers 40, 140A, 140B. The aft portion of fabric 252 is then fixed to the aft portion of deck 234, as described above. At this point, cover 240 is fully deployed as shown in FIGS. 16C and 17.

When the user desires to retract cover 240, the aft portion of fabric 252 may be removed from its fixed position at the aft portion of deck 234 and allowed to retract. In some embodiments, winding assembly 242 may include a ratchet mechanism which allows the fabric 252 to remain in a partially or fully deployed position without automatic retraction under the biasing force of the torsion spring, unless and until the ratchet mechanism is released, e.g., by pulling and releasing the fabric 252. Once so released (or in embodiments without a ratchet mechanism), fabric 252 may automatically retract under the biasing force of the torsion spring. For example, the user may hold handles 262 and simply walk the fabric 252 forward as winding assembly winds fabric 252 around shaft 244. Lid 264 may then be replaced upon housing 266. At this point, cover 240 is again fully retracted as shown in FIGS. 16A and 16D.

Optionally, cover 240 may include poles 248 extending across the lateral span of deck 334 from the starboard side of railing 336 to the port side thereof. Poles 248 may be made of a flexible material and/or be collapsible, and are coupled to railing 336 by magnets or other couplers and described herein with respect to covers 40, 140A, 140B. Poles may be configured, by flexing and/or collapsing, to fit within container 260 together with fabric 252 when cover 240 is collapsed.

Fabric 52, 54, 152 and 252 may be made from nylon, canvas, or waxed cotton, or any other material which is substantially waterproof and durable for use in outdoor applications.

While this invention has been described as having exemplary designs, the present invention may be further modified with the spirit and scope of this disclosure. Further, this application is intended to cover such departures from the present disclosure as come within known or customary practice in the art to which this invention pertains.

What is claimed is:

1. A cover for a personal watercraft, the cover comprising:

a fabric sized to be received over a portion of the personal watercraft enclosed by a railing, the fabric having a pair of attachment points configured for attachment to a deck of the personal watercraft; and a plurality of collapsible poles coupled to an undersurface of the fabric and extendable from a storage configuration to an extended configuration, each of the plurality of collapsible poles having an end configured for attachment to the deck of the personal watercraft;

wherein the end of each of the plurality of poles is sized to be received within a fixation bracket mounted to a forward edge of the deck of the personal watercraft.

2. The cover of claim 1, wherein the pair of attachment points comprises a pair of stern attachment loops configured to be attached to a cleat or hook fixed to the deck.

3. The cover of claim 2, further comprising a handle configured for grasping by a user of the cover, the handle positioned between the pair of stern attachment loops.

4. A cover for a personal watercraft, the cover comprising:

a fabric sized to be received over a portion of the personal watercraft enclosed by a railing;

a container sized and configured to be fixed to a bow portion of the personal watercraft, the container containing the fabric when the cover is in a collapsed configuration; and a lid receivable over the container to enclose the cover in the collapsed configuration;

wherein an aft edge of the fabric is fixed to an undersurface of the lid.

5. The cover of claim 4, further comprising a pair of handles attached to an upper surface of the lid.

6. The cover of claim 4, further comprising a winding assembly received in the container, the winding assembly comprising a spring-loaded shaft around which the fabric is wound when partially for fully collapsed within the container.

7. A cover for a personal watercraft, the cover comprising:

a first end section sized and configured to be mounted to a bow of the watercraft;

a second end section sized and configured to be mounted to a stern of the watercraft;

a middle section sized and configured to be mounted to a middle portion of the watercraft between the first end section and the second end section;

a pole retainer abutting an undersurface of a fabric of at least one of the first end section, the second end section and the middle section; and a plurality of poles coupled to the pole retainer and extending radially outwardly from the pole retainer, the poles having a curved shape which imparts a convex, generally dome-shaped profile to the at least one of the first end section, the second end section and the middle section.

8. The cover of claim 7, wherein the first end section is substantially identical to the second end section.

9. The cover of claim 7, wherein:

the first end section comprises a pair of side flaps configured to extend over starboard and port edges of the railing, and a bow flap configured to extend over a forward edge of the railing;

the second end section comprises a pair of side flaps configured to extend over starboard and port edges of the railing, and a stern flap configured to extend over an aft edge of the railing; and the middle section comprises a pair of side flaps configured to extend over starboard and port edges of the railing.

10. The cover of claim 9, wherein:

the first end section comprises a first attachment feature at an aft edge thereof, the aft edge opposite the bow flap;

the second end section comprises a second attachment feature at a forward edge thereof, the forward edge opposite the stern flap;

the middle section comprises a third attachment feature at a forward edge thereof, the third attachment feature positioned and configured to couple with the first attachment feature; and the middle section comprises a fourth attachment feature at an aft edge thereof, the fourth attachment feature positioned and configured to couple with the second attachment feature.

11. The cover of claim 7, wherein the plurality of poles are fixed to the adjacent undersurface by at least one loop fixed to the fabric.

12. The cover of claim 7, further comprising a post having a lower end configured to be supported upon a of the personal watercraft, and an upper end received within a post aperture formed in an undersurface of the pole retainer.

13. The cover of claim 7, wherein:

the pole retainer comprises a plurality of pole apertures extending radially inwardly from a periphery thereof, each of the plurality of pole apertures sized to receive an end of one of the plurality of poles;

a detent slider received in each of the plurality of pole apertures and positioned to bear on the end of an adjacent one of the plurality of poles; and a biasing element received in each of the plurality of pole apertures, the biasing element positioned to urge the detent slider into contact with the end of the adjacent one of the plurality of poles.

* * * * *